US006262663B1

(12) United States Patent
Altwasser et al.

(10) Patent No.: US 6,262,663 B1
(45) Date of Patent: Jul. 17, 2001

(54) ELECTRONIC ANTI-THEFT ELEMENT

(76) Inventors: Richard Altwasser, Kocherstrasse 8, D-76684 Forst (DE); Peter Lendering, Dr. Borggreveplein 4, NL-7060 CR Terborg (NL)

( * ) Notice: Subject to any disclaimer, the term of this patent is extended or adjusted under 35 U.S.C. 154(b) by 0 days.

(21) Appl. No.: 09/147,646

(22) PCT Filed: Jul. 29, 1997

(86) PCT No.: PCT/EP97/04116

§ 371 Date: Feb. 8, 1999

§ 102(e) Date: Feb. 8, 1999

(87) PCT Pub. No.: WO98/06075

PCT Pub. Date: Feb. 12, 1998

(30) Foreign Application Priority Data

Aug. 6, 1996 (DE) ..... 196 31 775
Feb. 14, 1997 (DE) ..... 197 05 723

(51) Int. Cl.[7] ..... G08B 13/14
(52) U.S. Cl. ..... 340/572.5; 340/572.7
(58) Field of Search ..... 340/572.5, 572.7

(56) References Cited

U.S. PATENT DOCUMENTS 3,967,161 6/1976 Lichtblau ..... 361/765
4,498,076 2/1985 Lichtblau ..... 340/572.3
4,567,473 1/1986 Lichtblau ..... 340/572.3
5,510,770 4/1996 Rhoads ..... 340/572.3

FOREIGN PATENT DOCUMENTS

0285559A1 10/1988 (EP) .
0509289A2 10/1992 (EP) .
0755036A1 1/1997 (EP) .
WO 91/09387 6/1991 (WO) .
WO 94/12957 6/1994 (WO) .

*Primary Examiner*—Benjamin C. Lee

(57) ABSTRACT

An electronic anti-theft element consists of at least one spiral printed circuit, a capacitor and a dielectric layer arranged therebetween, or of two spiral printed circuits which are arranged on respective sides of a dielectric layer in an at least partially overlapping manner (forming resonant circuit). The object of the invention is to provide a resonant circuit which is less liable to be reactivated. For that purpose, in at least one selected area (a rated break point) of the dielectric layer a short-circuit is created between the opposite capacitor plates or spiral printed circuits when a sufficiently high energy is supplied by a magnetic alternating field. The selected area is locally reinforced, preventing the suppression of the short-circuit by mechanical stress and the reactivation of the anti-theft element.

18 Claims, 4 Drawing Sheets

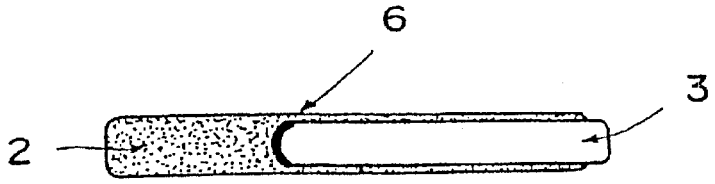
FIG. 4
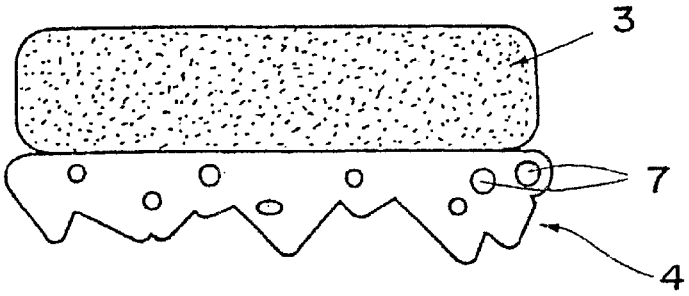
FIG. 5
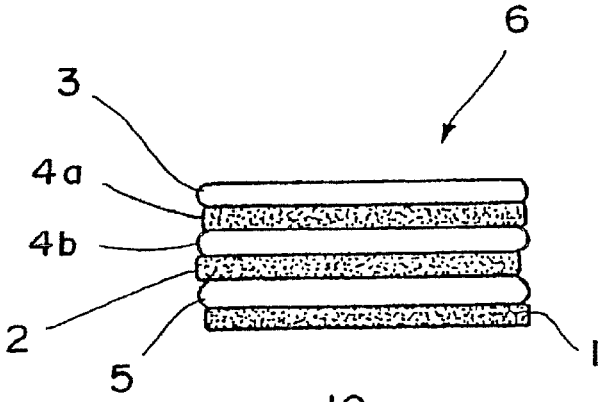
FIG. 6
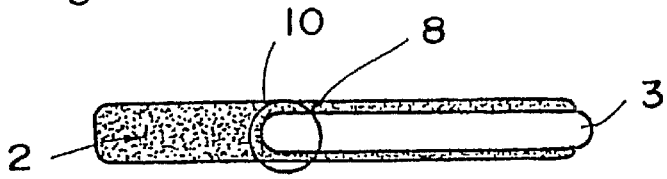
FIG. 7
FIG. 8a
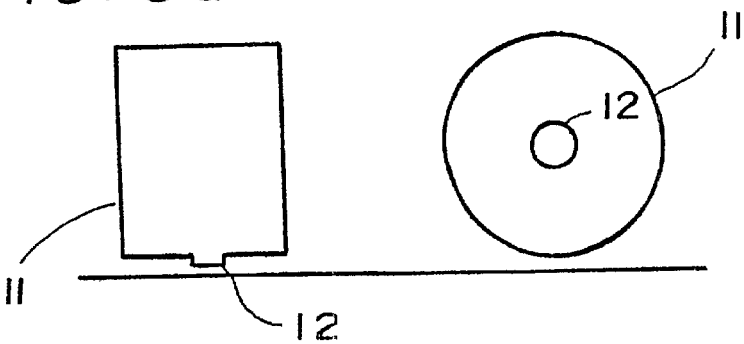
FIG. 8b

ELECTRONIC ANTI-THEFT ELEMENT

CROSS-REFERENCE TO RELATED APPLICATION

This application discloses subject matter in common with co-pending application Ser. No. 09/147,645, filed Feb. 8, 1999.

FIELD OF THE INVENTION

The present invention relates to a security element for electronic article surveillance, comprising at least one coiled conductive track and a capacitor having a dielectric layer arranged therebetween, or comprising two coiled. conductive tracks that are disposed on either side of a dielectric layer so as to overlap at least in part to form a resonant circuit.

BACKGROUND OF THE INVENTION

Resonant circuits which are excited to resonate at a predetermined resonant frequency which is conventionally at 8.2 MHz are widely accepted to protect articles against pilferage in department stores. Frequently the circuits are an integral part of adhesive labels or cardboard tags which are affixed to the articles to be maintained under surveillance. Typically, the department store has an electronic surveillance system installed in the exit area, which detects the resonant circuits and produces an alarm when a protected article passes through a surveillance zone in an unauthorized manner. The resonant circuit is deactivated when a customer has paid the merchandise. This prevents an alarm being produced once an article has been rightly acquired by purchase, passing through the surveillance zone subsequently.

The deactivation systems which are frequently installed in the checkout areas generate a resonant signal of a higher amplitude than it is produced in the surveillance systems. A resonant label is normally deactivated with a field strength greater than 1.5 Ampere-turns per meter, A/m.

A variety of deactivating mechanisms for resonant circuits are known in the art. They involve either destroying the insulation between two opposing conductive tracks, producing a short circuit, or subjecting a length of conductive track to overload and causing it to melt, thereby interrupting the circuit path. As a consequence of deactivation, the resonant properties of the resonant circuit, that is, the resonant frequency and/or the "Q" factor are modified so severely that the resonant label stops being detected by the surveillance system.

There is a risk that the deactivated resonant circuit may be reactivated inadvertently by mechanical manipulation including, for example, folding, packaging and transporting the merchandise, or bending the label and hence the resonant circuit. Any accidental reactivation of a resonant circuit which is affixed to an article rightly acquired by purchase may then produce an alarm leading to embarrassment both for the customer and for the department store.

So far no state of the art has become known which concerns itself with the problem of diminishing the risk of an accidental reactivation of resonant labels that are already deactivated. With regard to the deactivation of resonant labels, different methods have been described in the art. In U.S. Pat. No. 4,876,555 and its corresponding European Patent, EP 0 285 559 B1 a it is proposed to use a needle to produce a hole in the insulating layer between two opposite capacitor surfaces. This results in a fault-free and permanent deactivation mechanism.

U.S. Pat. No. 5,187,466 describes likewise a method for generating a deactivatable resonant circuit by means of a short circuit that cannot be destroyed under normal circumstances.

As regards the first mentioned U.S. Pat. No. 4,876,555 and its corresponding European Patent, EP 0 285 559 B1, it should be noted that the resonant circuit therein disclosed includes capacitor plates which are disposed on either side of a dielectric material. The dielectric layer arranged between the two capacitor plates has a through hole.

In U.S. Pat. No. 5,187,466 referred to in the foregoing, a method is described which is applied to a resonant circuit having capacitor plates on either side of a dielectric, and in which the capacitor plates are first short-circuited and the short circuit is melted later by the application of electrical energy.

Still further important techniques in the field of the de-activation of resonant labels are known which however do not concern themselves with the reduction of the risk of an accidental reactivation. A patent family extending in this direction comprises, among others, European Patent, EP 0 181 327 B1, U.S. Pat. No. 4,567,473 and U.S. Pat. No. 4,498,076. The resonant label of the present invention which is described in these patents is composed of the following components: a substrate material serving as a dielectric, capacitor plates on either side of the planar dielectric substrate material, a deactivation zone and a resonant circuit which is disposed on the dielectric material. Heretofore the state of the art has not indicated any provisions that would prevent an undesirable reactivation after deactivation has taken place successfully.

SUMMARY OF THE INVENTION

It is an object of the present invention to provide a resonant circuit in which the probability of reactivation is reduced.

This object is accomplished in that provision is made in the dielectric layer for at least one selected area (a zone of preferred breaking) in which a short circuit is produced between the opposed capacitor plates or the coiled conductive tracks by the supply of energy in a sufficiently high amount by an alternating magnetic field, and in which the selected area is strengthened locally such that a destruction of the short circuit (conductive path) by mechanical loads, and hence a reactivation of the security element, are prevented.

According to an advantageous further aspect of the security element of the present invention, provision is made for the dielectric layer to be of substantially uniform thickness and to have no additional manufacturing defects (air inclusions, for example).

According to a yet further proposal, in the event that two, at least partly overlapping tracks, are used they are wound in opposite directions, with the selected area being located at the outer ends of the tracks. This is the point where the induced voltage is at its highest level.

In an advantageous aspect of the security element of the present invention, it is proposed to make the dielectric layer in the selected area thinner than in the remaining areas.

According to an alternative solution, the selected area is characterized in that the dielectric layer has in this area a different physical or chemical property than in the remaining areas.

According to an advantageous further aspect of the security element of the present invention, the dielectric layer is comprised of at least two components. In this connection it is particularly advantageous for the melting point of the one component of the dielectric layer to lie above the production temperature for security elements. According to a still further aspect, the components of the dielectric layer are of a nature enabling them to be fabricated by either a coating or a laminating process.

According to an advantageous feature of the security element of the present invention, the selected area in which the deactivation takes place is strengthened by the application of additional pressure. Compression enhances the bond between the capacitor plates or the at least partly overlapping tracks. It has proven to be advantageous to use pressure forming techniques for strengthening which involves forming the capacitor plates or the at least partly overlapping tracks into a three-dimensional shape. In this regard it is particularly advantageous if the enhanced bonding and the forming of the capacitor plates or tracks are accomplished in a single operation.

When the resonant circuit is bent or folded in the area of the strong zone, that is the zone where deactivation takes place, there is still a risk that the resonant circuit may buckle, shear, slide or delaminate at the point of deactivation. This would cause undesirable reactivation of the resonant circuit. In order to forestall this risk, a further aspect of the present invention involves providing weak zones on either side of the strong zone. When an external bending moment is applied, the resonant circuit is much more likely to fold or even break in the area of the weak zones than to fold or break within the strong zone. The weak zone may therefore be referred to as the zone of preferred bending or breaking.

One approach to obtaining the weak zones involves narrowing down the width of the track. Alternatively, the possibility exists of treating treat the adhesive layer in these weak zones so that there is significantly reduced bonding between the coiled tracks. Alternatively again, the weak zones may be made by perforating the tracks.

According to a yet further advantageous aspect of the present invention, the resonant circuit is configured such that the capacitance between the upper and lower track is concentrated at the inner ends of the coils. In particular, at the inner ends of the coils the area of track overlap is large, resulting in a proportionally large capacitance, while the area of overlap at the outer ends of the coils is very small.

In a yet further advantageous aspect of the device of the present invention, it is proposed that the areas of overlap between the two tracks and hence the capacitance between the tracks be concentrated at the inner ends of the tracks. In particular, the outer ends of the two tracks overlap in a small area, and there is a relatively long area with no overlap adjacent to the outer ends of the tracks. An advantage of this topology is that it results in deactivation taking place in the area of overlap between the outer ends of the upper and lower tracks as this is the point of highest voltage potential between the tracks.

Therefore, there is a high degree of certainty that the point of deactivation is in the selected area.

The present invention will be explained in more detail in the following with reference to the accompanying drawings.

BRIEF DESCRIPTION OF THE DRAWINGS

FIG. 4 is a plan view of the outer end area of the coiled tracks;

FIG. 5 is an enlarged cross sectional view of the upper coil and the upper component of the dielectric layer;

FIG. 6 is a detailed cross-sectional view of the resonant circuit of the present invention;

FIG. 7 is a plan view of a strong zone;

FIG. 8*a* shows a relevation view of a suitable tool;

FIG. 8*b* shows a front view of the tool of FIG. 8*a*

DESCRIPTION OF THE PREFERRED EMBODIMENTS

Figure 1B:
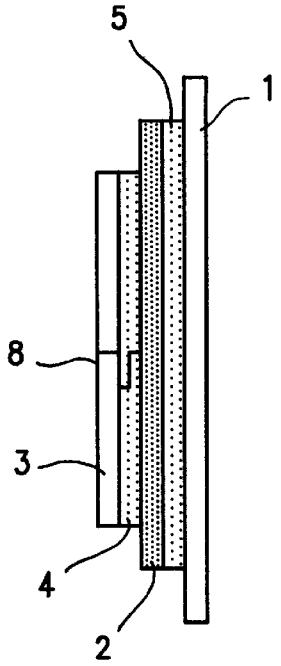
FIG. 1*b* is a side view in the direction of the arrow A in FIG. 1*a;*
Figure 1A:
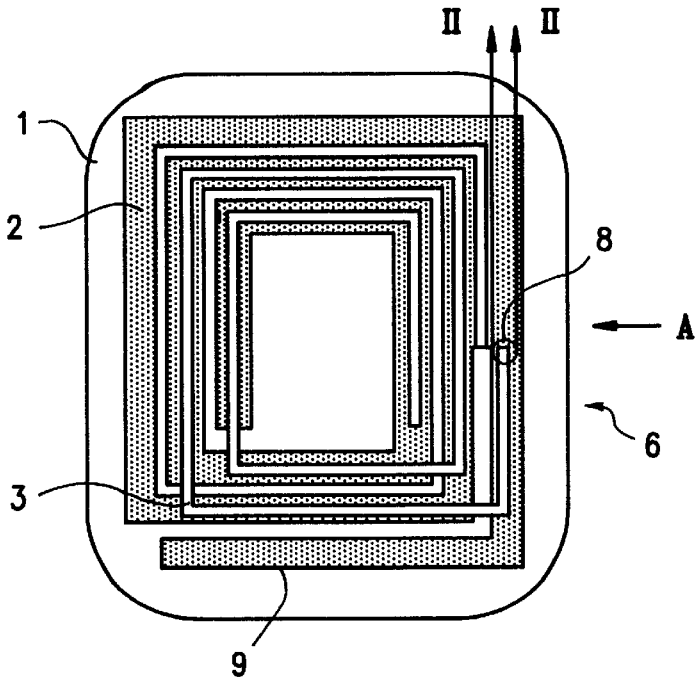
FIG. 1*a* is a plan view of an embodiment of the resonant circuit of the present invention.
Figure 2:
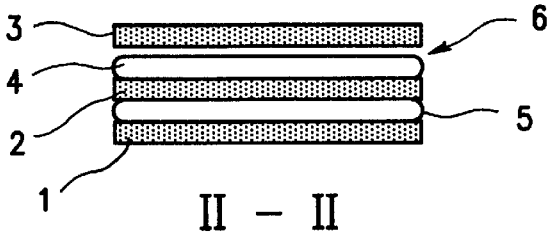
FIG. 2 is a cross sectional view taken along the line II—II of FIG. 1*a*.

FIGS. 1*a* and 1*b* show an embodiment of the resonant circuit 6 of the present invention and in side view, respectively in plan view. Included are two coiled conductor tracks 2 and 3. The tracks 2 and 3 are separated by a dielectric layer 4, while the track 2 is separated from the substrate 1 by a dielectric layer 5. FIG. 2 shows the resonant circuit 6 of FIG. 1 in cross sectional view. Deactivation of the resonant circuit 6 takes place by producing a short circuit between, for example the two coiled conductive tracks 2, 3, through the dielectric layer 4. The two coiled conductive tracks are preferably fabricated from aluminum. The application of an alternating magnetic field as emitted, for example, by the surveillance system induces alternating voltages in the two coiled tracks 2, 3 of the resonant circuit 6. The coiled tracks 2, 3 overlap at least in part and are wound in opposite directions. Therefore, the outer end of the lower coil 2 has a positive potential with respect to the inner end of the lower coil 2 when the inner end of the upper coil 3 has a positive potential with respect to the outer end of the upper coil 3. It will be understood, therefore, that the points/areas in which the induced alternating voltages between the two coils 2, 3 are at their highest levels are located in the end areas of the coils 2, 3. The point of overlap is adjacent a relatively long length of track (9 in FIG. 1*a*) having no overlap.

Considering that in the example illustrated in FIG. 1 the upper coil 3 has fewer turns than the lower coil 2, the highest voltages are generated between the ends of the upper coil 3 and the areas of the lower coil 2 situated directly underneath.

Figure 3:
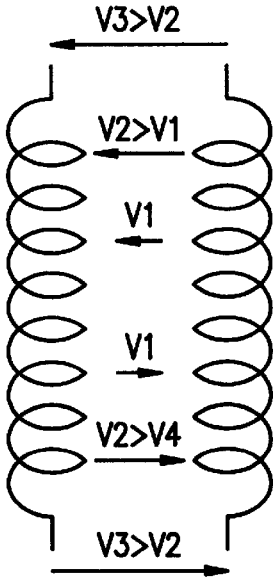
FIG. 3 is an equivalent electrical circuit illustrating the voltages occurring in two partly overlapping coiled tracks.

FIG. 3 illustrates clearly the voltage relationships in different areas of the two at least partly overlapping coils 2, 3 of a resonant circuit 6 that is suitable for use according to an advantageous further aspect of the resonant circuit 6 of the present invention.

In the resonant circuit 6 previously described in which the dielectric layer 4 between the coils 2, 3 is of uniform thickness, deactivation takes place in the end areas of the upper coil 3 and the lower coil 2, because this is where the induced potential is at its highest level. Because the electric field strength is focused on a surface with a small radius, deactivation takes place precisely at the ends of the tracks 2, 3, as shown in FIG. 4. The dielectric layer 4 may be thinner at this point (as seen at 8 in FIG. 1*b*) to enhance deactivation.

If however the dielectric layer 4 is not of uniform density or contains air inclusions 7 which may happen easily as a result of manufacturing defects, deactivation may take place in various areas of the coils 2, 3. Such manufacturing defects may cause local weaknesses and even produce holes resulting from air inclusions 7 in the dielectric layer 4. As a consequence, the dielectric layer 4 breaks down at these local weak points although the voltage potential is lower at these points than it is at the ends of the upper and lower track 3, 2. Because the voltage potential is lower at the local weak points than it is at the ends of the tracks 2, 3, the electrical energy available for producing the deactivation short circuit is smaller than the electrical energy that would be necessary to produce a deactivation short circuit at the ends of the upper coil 3.

FIG. 5 shows a cross section of a dielectric layer 4 exhibiting manufacturing defects in the form of air inclusions 7 and irregularities in the surface area. To avoid such manufacturing defects, the dielectric layer 4 is configured in a further aspect so that it is substantially uniform in thickness and largely. free from local weak points 7. Such a uniform dielectric layer 4 ensures deactivation in the end areas of the coiled tracks 2, 3 as this is the point of highest induced voltage and energy. A short circuit produced by such deactivation is very robust with little susceptibility to accidental reactivation.

According to an advantageous further aspect of the resonant circuit 6 of the present invention, the dielectric layer 4 is comprised of at least two components 4*a*, 4*b*, including an upper component 4*a* and a lower component 4*b*. The lower component 4*b* is applied to the lower coil 2 prior to stamping and hot embossing. The upper component 4*a* is applied to the upper coil 3. The upper component 4*a* has a relatively low melting point enabling it to serve as a hot-melt-type adhesive and to adhesively bond the two coils 2, 3 together during hot embossing of the upper coil 3 onto the lower coil 2. The upper component 4*a* of the dielectric layer 4 melts during hot embossing of the upper coil 3. Having a higher melting point, the lower component 4*b* of the dielectric layer 4 does not melt during hot embossing on the upper coil 3. The uniformity of the lower component 4*b* of the dielectric layer 4 which does not melt improves overall the uniformity of thickness of the dielectric layer 4.

FIG. 6 shows a cross section of a resonant circuit 6 having a dielectric layer 4 composed of two components 4*a*, 4*b*. The lower component 4*b* may be produced either by coating the lower coil 2 or by laminating the lower component 4*b* of the dielectric layer 4 onto the coil 2. Typically the coil material is aluminum, and is available in the form of broad coils enabling surface uniformity of the surface of the dielectric layer 4 to be maintained, and to minimize other defects, such as, for example, air inclusions 7.

There is the risk that the short circuit may be broken by folding or other mechanical manipulations, even when the dielectric layer 4 is so uniform that defects 7 are largely reduced and the deactivation short circuit occurs exclusively at the end of the upper track where the induced energy is at its highest level. (This applies of course only in cases where no selected zone of preferred breaking is provided.) Relative shearing or sliding motions of the two metal layers or delamination of the two layers may result in an accidental reactivation.

According to the present invention, the resonant circuit 6 is locally strengthened in the area of the ends of the upper coil 3 or in the zone of the treated area. The strong zone 10 is less susceptible to shearing and sliding motions or delamination. By strengthening locally, any stresses, strains or loads imposed on the resonant circuit 6 by folding or bending can be reduced because the two coiled tracks 2, 3 shear, slide, fold or delaminate only in the proximity of, yet not within, the locally strengthened zone 10.

According to an advantageous further aspect of the resonant circuit 6 of the present invention, the zones around the ends of one of the two tracks 2, 3, here of the upper track 3, are strengthened by the application of an additional pressure to a local zone 10, with the metal, which is preferably aluminum, being formed such as to assume a non-plane shape. Local pressure application effects an improved bond between the two tracks 2, 3 and between the lower track 2 and the dielectric layer 4. When this pressure is applied by means of a forming tool 11 having a protuberance with a predetermined profile (punch 12), it is possible to form the tracks 2, 3 so that the resistance of the resonant circuit 6 to reactivation is materially improved. It will be understood, of course, that the tool 11 may also be of a flat configuration and have predetermined dimensions.

With regard to the structural properties of metals it is well known that a piece of sheet metal having grooves, bulges or other worked in structures is less susceptible to bending than a flat piece of sheet metal. The same principle is applied here to produce a locally strengthened zone 10. Any folding or bending of the resonant circuit 6 over a large surface area leads to bending, folding, shearing or delaminating of the resonant circuit 6 in the proximity of, yet not within the strong zone 10. This reduces the risk of an inadvertent reactivation. The actual shape of the strong zone 10 is not crucial, nor is the actual profile of the formed track 2, 3 in the strong zone 10 critical.

FIG. 7 shows an embodiment of in plan view of a strong zone 10 at one end of the upper track 3.

FIG. 8*a* is a elevational view and FIG. 8*b* a front view of a tool 11 suitable for producing the strong zone 10.

Figure 9:
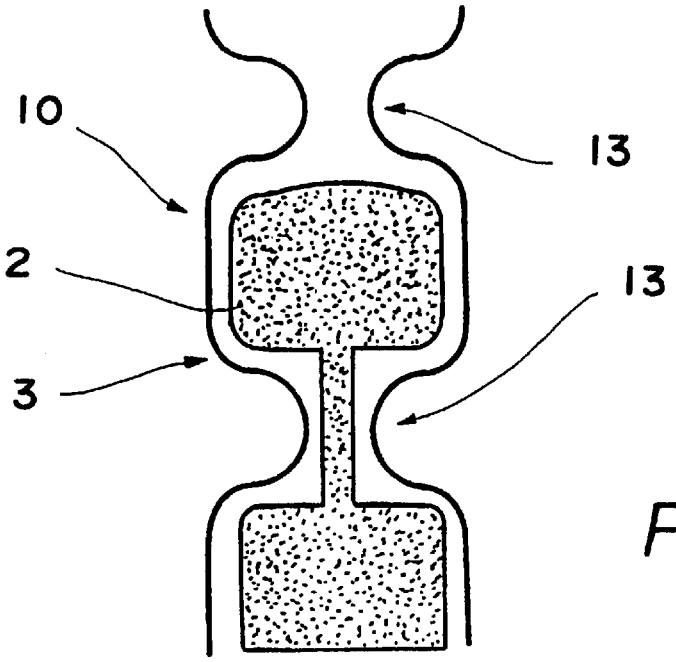
FIG. 9 is a plan view of a track with a weak zone.
Figure 10:
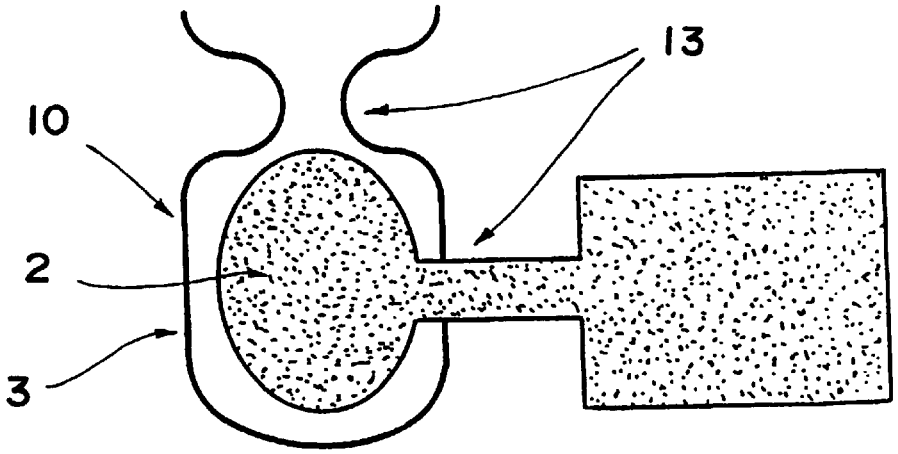
FIG. 10 is a plan view of a further track with a weak zone.

When the resonant circuit 6 is bent or folded in the area of the strong zone 10, that is the zone where deactivation is known to take place and which has been deliberately strengthened, there is still a risk that the resonant circuit 6 may buckle, shear, slide or delaminate. This would cause undesirable reactivation of the resonant circuit 6. In order to forestall this risk, a further aspect of the present invention involves providing weak zones 13 on either side of the strong zone 10. When an external bending moment is applied, the resonant circuit 6 is likely to fold or even break in the area of the weak zones 13. The weak zone 13 may therefore be referred to as the zone of preferred bending or breaking. The weak zone 13 may be made weak either by narrowing down the width of the track 2, 3 as shown in FIG. 9 and FIG. 10, or alternatively by suitably treating the adhesive layer in this weak zone 13 so that there is significantly weaker bonding between the tracks 2, 3. A further possibility to obtain weak zones 13 involves perforating the tracks 2, 3.

Figure 11A:
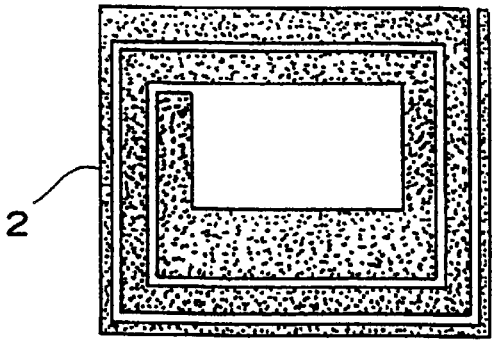
FIG. 11*a* is a plan view of a configuration of the lower coil.
Figure 11B:
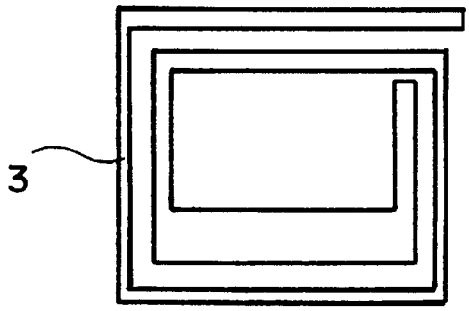
FIG. 11*b* is a plan view of a configuration of the upper coil.
Figure 11C:
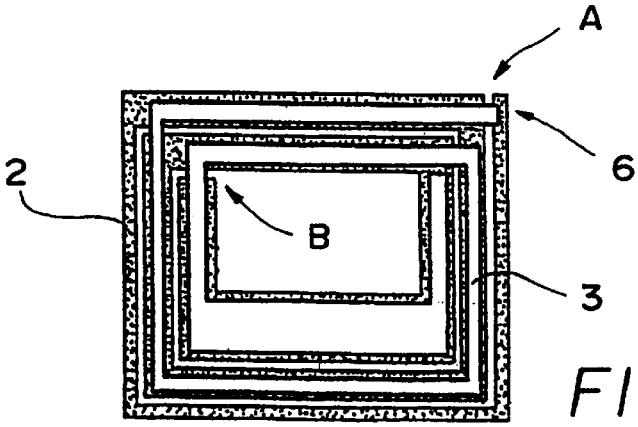
FIG. 11*c* is a view of the resonant circuit as composed from the coils shown in FIG. 11a and FIG. 11b.

In a yet further aspect of the present invention, the tracks 2, 3 and the resonant circuit 6 are configured in such a way that the capacitance between the upper and lower tracks 3, 2 is concentrated at the inner ends of the coiled tracks 2, 3. A corresponding resonant circuit 6 is shown in FIG. 11*a*, FIG. 11*b* and FIG. 11*c*. As becomes apparent from the Figures, at the inner ends of the coils 2, 3 the area of overlap of the tracks 2, 3 is large, resulting in a proportionally large capacitance, while at the outer ends of the coils 2, 3 the point of overlap is very small.

Figure 12:
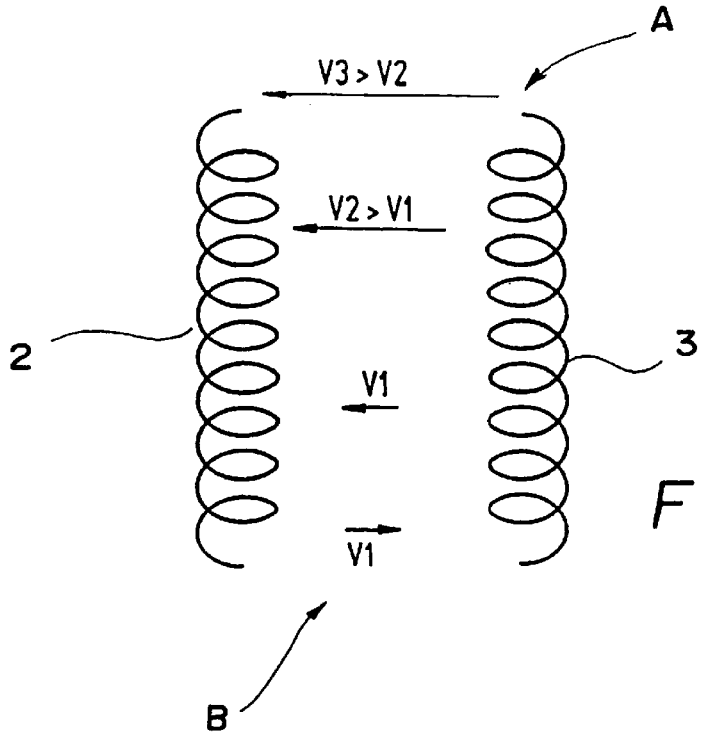
FIG. 12 is an equivalent electrical circuit illustrating the voltage relationships of the embodiment of the resonant circuit of the present invention illustrated in FIG. 11*c*.

The equivalent circuit of this arrangement is shown in FIG. 12. The voltage difference generated between the two coils 2, 3 at the outer ends of the coils is significantly larger than at any other point between the coils 2, 3. Studying FIG. 11*c* and FIG. 12 together it will also be noted that a large part of the outer turn of the lower track 2 is not overlapped by the upper track 3 at all. Thus there is no possibility of deactivation taking place along this section of no overlap. Tracing the outer turn of the lower track 2 back from the end point where there is a small area of overlap with the upper track 3, it will be noted that the next point at which there is overlap of the tracks 2, 3 and therefore the possibility of deactivation exists, is further back along the outer turn of the lower track 2. This point has considerably less voltage potential between the upper and lower tracks 3, 2.

Even if the dielectric layer 4 between the two tracks is not perfectly uniform in thickness or perfectly free from other weaknesses 7, deactivation will take place at this point of outer overlap because there is considerably more potential difference between the tracks 2, 3 at this point.

A further advantage is that because the distribution of potential difference along the length of the tracks 2, 3 is no longer even, the amount of energy available to make a deactivating short circuit between the tracks 2, 3 needs to be higher than it would be with an even distribution of voltage and capacitance. Higher energy in turn means a more reliable short circuit and hence automatically less risk of accidental reactivation.

What is claimed is:

1. A security element for electronic article surveillance, comprising: a capacitor element; at least one coiled conductive track; and a dielectric layer arranged so as to overlap said at least one coiled conductive track at least in part, wherein the dielectric layer includes at least one selected area serving as a zone of preferred breaking in which a short circuit is produced between the opposed capacitor element and the at least one coiled conductive track by a supply of energy in a sufficiently high amount by an alternating magnetic field, and wherein the selected area is strengthened locally, such that a destruction of the short circuit by mechanical loads, and hence a reactivation of the security element are prevented.

2. The security element as claimed in claim 1, wherein the dielectric layer is of substantially uniform thickness and has uniform density.

3. The security element as claimed in claim 2, wherein the areas of overlap between said two coiled conductive tracks and hence the capacitance between said two coiled conductive tracks are concentrated at the inner ends of said two coiled conductive tracks.

4. The security element as claimed in claim 3, wherein the outer ends of said two coiled conductive tracks overlap in a small area and there is a relatively long area with no overlap adjacent to the outer ends of said two coiled conductive tracks.

5. The security element as claimed in claim 1, wherein two, at least partly overlapping, coiled conductive tracks are provided, being wound in opposite directions, with the selected area being located in the outer end areas of said two coiled conductive tracks where the induced voltage is at its highest level.

6. The security element as claimed in claim 5, wherein said dielectric layer is fabricated by one of a coating or a laminating process.

7. The security element as claimed in claim 5, wherein weak zones are provided on one or both sides of said selected area.

8. The security element as claimed in claim 7, wherein said weak zones are formed by narrowing down the width of said two coiled conductive tracks.

9. The security element as claimed in claim 7, wherein in said weak zones the dielectric layer is less strongly bonded to said capacitor element or said two coiled conductive tracks than in the remaining areas.

10. The security element as claimed in claim 7, wherein said weak zones are characterized in that the said two coiled conductive tracks are perforated.

11. The security element as claimed in claim 1, wherein the selected area is characterized in that the dielectric layer is thinner in said selected area than in the remaining areas.

12. The security element as claimed in claim 1, wherein the selected area is characterized in that the dielectric layer has in said area a different chemical or physical property than in the remaining areas.

13. The security element as claimed in claim 1, wherein the dielectric layer is comprised of at least two components.

14. The security element as claimed in claim 13, wherein the melting point of one component of dielectric layer lies above the production temperature for security elements.

15. The security element as claimed in claim 1, wherein two coiled conductive tracks are provided, with at least one coiled conductive track defining a strong zone, and wherein the strengthening in said strong zone is accomplished by the application of additional pressure to enhance the bond at said capacitor element or at at least partly overlapping ones of said two coiled conductive tracks.

16. The security element as claimed in claim 15, wherein said strong zone is obtained by pressure forming said capacitor element or the at least partly overlapping ones of said two coiled conductive tracks into a three-dimensional shape.

17. The security element as claimed in claim 15, wherein the enhanced bonding and the forming of said capacitor element or said two coiled conductive tracks are accomplished in a single operation.

18. The security element as claimed in claim 1, wherein said selected area is characterized in that the dielectric layer has holes resulting from air inclusion.

* * * * *